US005183186A

United States Patent [19]

Delaney, Jr.

[11] Patent Number: 5,183,186

[45] Date of Patent: Feb. 2, 1993

[54] SPRAY DISPENSING DEVICE HAVING A TAPERED MIXING CHAMBER

[75] Inventor: Henry W. Delaney, Jr., North Branford, Conn.

[73] Assignee: Emson Research Inc., Bridgeport, Conn.

[21] Appl. No.: 745,538

[22] Filed: Aug. 15, 1991

[51] Int. Cl.[5] ..... B65D 37/00

[52] U.S. Cl. ..... 222/211; 222/212; 222/484; 222/488; 222/632; 239/327; 239/401; 239/405; 239/470

[58] Field of Search ..... 222/206, 211, 212, 215, 222/484, 488, 554, 631, 632, 633; 239/328, 327, 401, 405, 470

[56] References Cited

U.S. PATENT DOCUMENTS

| | | | |
|---|---|---|---|
| 1,154,163 | 9/1915 | Ballou | 222/496 |
| 1,229,029 | 6/1917 | Burbage | 222/497 |
| 1,716,525 | 6/1929 | Leong | 239/327 |
| 1,729,979 | 10/1929 | Bell | 222/496 |
| 1,732,513 | 10/1929 | Holmes | 222/484 |
| 1,977,500 | 10/1934 | Tierman | 221/60 |
| 2,009,027 | 7/1935 | Sheehy | 221/60 |
| 3,141,579 | 7/1964 | Medlock | 222/207 |
| 3,163,362 | 12/1964 | McFee | 239/401 |
| 3,170,633 | 2/1965 | Castelli | 222/206 X |
| 3,185,352 | 5/1965 | Ghisolfi | 222/193 |
| 3,474,936 | 10/1969 | McDonnell | 222/211 |
| 3,510,061 | 5/1970 | Peczeli et al. | 239/470 X |
| 3,967,765 | 7/1976 | Micallef | 222/554 |
| 4,015,753 | 4/1977 | Bennett | 222/193 |
| 4,020,982 | 5/1977 | Micallef | 222/554 |
| 4,024,992 | 5/1977 | Schmid | 222/211 |
| 4,122,979 | 10/1978 | Laauwe | 222/633 |
| 4,157,789 | 6/1979 | Laauwe | 239/327 |
| 4,162,749 | 7/1979 | Bennett | 222/212 X |
| 4,186,882 | 2/1980 | Seczppanski | 239/327 |
| 4,401,270 | 8/1983 | McKinney | 239/327 |
| 4,473,185 | 9/1984 | Peterson et al. | 239/405 X |

FOREIGN PATENT DOCUMENTS

| | | | |
|---|---|---|---|
| 1416199 | 8/1988 | U.S.S.R. | 239/405 |
| 1153264 | 5/1969 | United Kingdom | 222/211 |
| 2198521 | 6/1988 | United Kingdom | 239/405 |

*Primary Examiner*—Andres Kashnikow
*Assistant Examiner*—Joseph A. Kaufman
*Attorney, Agent, or Firm*—Kenyon & Kenyon

[57] ABSTRACT

A spray dispensing device is provided which can be used with non-pressurized containers. The device includes passageways for directing streams of air and liquid to a mixing chamber wherein the liquid is broken up into droplets and emitted as a fine spray through an orifice. The device includes a dip tube for the liquid which is provided with a check valve for retaining liquid at a high level in the dip tube after each spray cycle so that spraying is nearly instantaneous upon actuation.

13 Claims, 3 Drawing Sheets

SPRAY DISPENSING DEVICE HAVING A TAPERED MIXING CHAMBER

FIELD OF THE INVENTION

The invention relates generally to devices for atomizing fluent materials. More particularly, this invention relates to highly efficient dispensing arrangement for use with squeeze type containers.

BACKGROUND OF THE INVENTION

Although squeeze bottle types sprayers have been used for many years, such sprayers were largely replaced for a long period of time by pressurized can dispensing systems. A major advantage to the use of pressurized cans is the nearly instantaneous spraying which occurs upon actuation. However, there has been an increasing concern over the harmful effects on the atmosphere of the propelling gases, such as fluorocarbons, which are used in such pressurized cans. In addition, pressurized can dispensing systems are relatively expensive to manufacture. Accordingly, squeeze bottle type sprayers and manual pump sprayers have become more prevalent in recent years.

Products which can be dispensed in the form of a spray can be easily atomizable liquids, such as water based materials, or viscous materials which are more difficult to atomize such as oil based materials. In the case of a pressurized can there is sufficient force available for mechanical means to break up liquid droplets into a fine spray. However, in squeeze bottle type sprayers the force required to break up droplets must be supplied manually, that is by squeezing the bottle. Therefore, it is much more difficult to achieve a high degree of atomization with such bottles.

Squeeze bottle type sprayers typically utilize a dip tube for directing liquid to a mixing chamber. Upon squeezing the bottle, air located above the liquid level is forced under pressure through a passage toward the mixing chamber where it impinges on a stream of the liquid in an effort to break up the liquid into droplets. The liquid is dispersed in a spray pattern through an orifice in the mixing chamber.

One major drawback to the use of dip tubes in conventional venturi squeeze bottles is that there is a delay in the dispensing of spray from the orifice upon squeezing the bottle. This delay is caused by the time which it takes for liquid to travel up the length of the dip tube upon squeezing the bottle. The delays become more prominent as product is used up and the level of fluid in the bottle drops. When the fluid level drops close to the container bottom, as much as 75% of a full "squeeze" may be required to raise the liquid up the length of the dip tube. Such delays are not encountered when using pressurized cans. It would therefore be advantageous to eliminate or abate the above described lag time in squeeze bottle type sprayers so as to emulate the nearly instantaneous spraying which occurs when using pressurized cans.

Another drawback to spray dispensing devices is that it has not been possible to effectively vary the liquid to air ratio of the dispensed spray. For example, U.S. Pat. No. 4,401,270 describes a typical squeeze bottle type sprayer which can dispense liquid in only two possible spray patterns, either a pure liquid stream or an air-liquid mixture having a fixed liquid/air ratio. It would be advantageous to provide a sprayer device which is capable of dispensing product such that the liquid to air ratio can be varied to provide either a wet spray or a dry spray, as desired.

SUMMARY OF THE INVENTION

It is an object of the invention to provide a spray dispensing device for use with a non-pressurized container, such as a squeeze bottle, wherein the lag time between squeezing the bottle and dispensing of product is minimized so as to approach instantaneous spraying.

It is another object of the invention to provide a spray dispensing device having a valve which can be adjusted to vary the liquid to air ratio of dispensed spray.

In accordance with the invention a spray dispenser is provided having a dip tube which can extend into a container, such as a squeeze bottle, holding a quantity of liquid. The top of the dip tube is connected to a ball-check valve assembly having a ball which ordinarily rests on top of a conduit of restricted diameter. An air passage in the spray dispenser can connect the inside of the bottle with a mixing chamber in the dispenser. A separate product passage leads from the top of the ball-check to the mixing chamber.

When the bottle is squeezed for the first time, the resulting pressure build up forces air into the mixing chamber and liquid up the dip tube. The liquid forces the ballcheck to open and the liquid is directed toward the mixing chamber. The stream of liquid is broken up in the mixing chamber by impinging air and a fine spray is expelled through an orifice. As the pressure in the bottle is relieved, the ball drops down back onto the conduit of restricted diameter thereby trapping product in the dip tube. Thus, product will be retained in the dip tube at a high level, above the liquid level in the bottle, ready for the next squeeze cycle. In this way the lag time which ordinarily occurs prior to spraying is eliminated.

The product passage and the air passage are formed in a valve which is housed in a body of the spray dispenser. In a closed position of the valve, both the air passage and the product passage are completely closed to the inside of the squeeze bottle. As the valve is adjusted toward a fully open position, the air passage opens. After the air passage is completely opened, continued adjustment of the valve toward the open position begins to open the product passage. Continued adjustment increases the extent of communication between the product passage and the ballcheck thereby increasing the volume of liquid per unit of time allowed to flow into the mixing chamber (i.e., the flow rate) and, hence, the ratio of liquid to air in the spray.

BRIEF DESCRIPTION OF THE DRAWINGS

These and other features and advantages of the present invention will become apparent from consideration of the following specification when taken in conjunction with the accompanying drawings in which.

DESCRIPTION OF THE PREFERRED EMBODIMENTS

Figure 1:
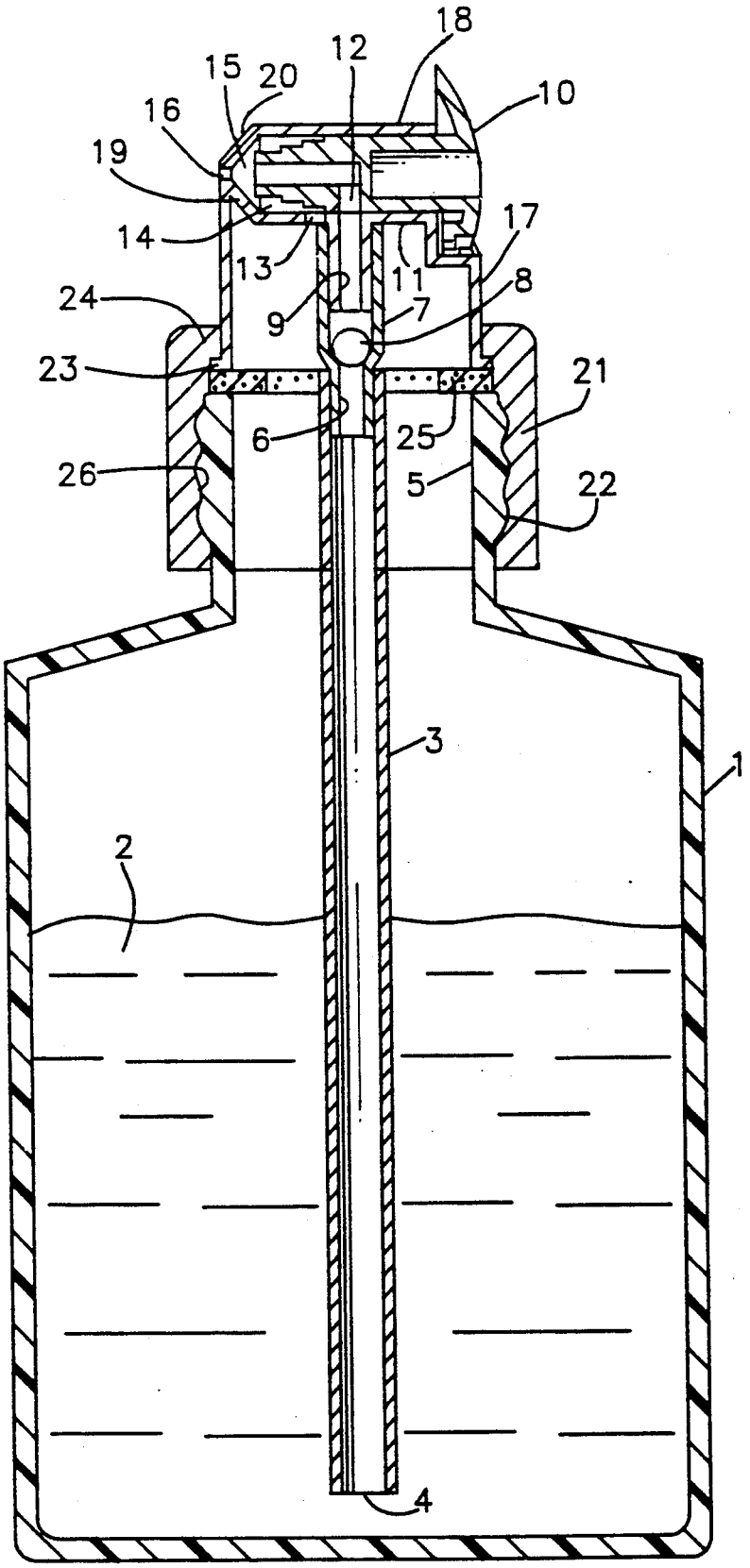
FIG. 1 is a cross-sectional view of a spray dispensing device in accordance with the invention, mounted on a squeeze type bottle, illustrating the valve in its fully open position.

Referring now more particularly to the drawings, and to those embodiments of the invention here chosen by way of illustration, it will be seen in FIG. 1 of the drawings that the spray dispensing system of the present invention will be described in connection with a squeezable bottle 1 holding a quantity of a liquid or other fluent material 2. Squeezable bottle 1 can be made from any suitable plastic known in the art.

A spray dispensing device housing 17 is adapted to be mountable atop a neck 5 of bottle 1. The device includes a dip tube 3 which is sized so that its bottom open end 4 is disposed near the bottom of bottle 1 when the spray dispensing device is mounted on the bottle. The top end of dip tube 3 receives a restricted conduit 6 of a ball-check valve 7. Restricted conduit 6 communicates with dip tube so as to allow fluid 2 to pass therethrough. The inner diameter of restricted conduit 6 is smaller than the diameter of ball 8 of ballcheck valve 7 so that ball 8 ordinarily sits atop restricted conduit 6. When ball 8 is in this position, the ballcheck valve 7 is closed so that the top end of dip tube 3 is also closed. The inner diameter of the remainder of ballcheck valve 7 is larger than the diameter of ball 8. In this way ball 8 is free to move upward in response to upward movement of fluid in the dip tube to open ballcheck valve 7.

The top of ballcheck valve 7 receives a coaxially disposed feed tube 9 which allows for the passage of fluid from restricted conduit 6 toward valve 10. Feed tube 9 has an inner diameter which is smaller than the diameter of ball 8 so as to limit the movement of ball 8 in an upward direction. Therefore, feed tube 9 is positioned a small distance upward from ball 8 so that ball 8 is free to move upward to open ballcheck valve 7.

For simplicity of construction feed tube 9 is an extension of a valve wall 11 of housing 17. Feed tube 9 of valve wall 11 can communicate with a product passageway 12 within valve 10 when valve 10 is in an open position, which will be described. Valve wall 11 is also provided with an air orifice 13 which can communicate with an air passageway 14 within valve 10 when valve 10 is in an open position. Valve 10 is rotatably received in the cavity between valve walls 11 and 8 of spray dispenser housing 17.

Tapered portions 19 and 20 of valve walls 11 and 18, respectively, define a cavity therebetween which shall be referred to as mixing chamber 15. Product passageway 12 leads to mixing chamber 15 in a generally horizontal direction. Air passageway 14 leads to the underside of mixing chamber 15. Tapered portions 19 and 20 terminate before meeting to define spray orifice 16 of mixing chamber 15. As can be seen from FIG. 1 and FIG. 2, the air passageway 14 is an annular passageway which is concentrically disposed around the section of the product passageway 12 which leads to the mixing chamber 15.

Housing 17 is connected to the top of bottle neck 5 by a ring 21. Ring 21 may be a screw cap whose inner surface is provided with helical threads 26 defining grooves which are engageable with helical threads 22 on the outer surface of neck 5. An outwardly extending lip 23 around the bottom periphery of housing 17 engages with an inwardly extending lip 24 of ring 21 to lock housing 17 onto bottle neck 5. A foam gasket 25 may be provided between lip 23 and the top of bottle neck 5 for enhanced sealing.

The spray dispensing device can be conveniently removed from bottle 1 as a unit by simply unscrewing ring 21 to separate housing 17 from bottle neck 5. This feature has the advantage of allowing the bottle 1 to be refilled with product 2. The spray dispensing system is then easily reconnected to bottle neck 5 by ring 21.

Valve 10 is housed within the cavity between valve walls 11 and 18 of housing 17. Valve 10 is rotatable about its longitudinal axis between a completely closed position (FIG. 2) and a completely open position (FIG. 1). In the completely closed position (FIG. 2) the product passageway 12 is not aligned with the feed tube 9. As illustrated in FIG. 2, in this position the body of valve 10 completely seals off feed tube 9.

The structure of valve 10 is such that as the valve is rotated toward the completely open position, the air passageway 14 first becomes aligned with air orifice 13 before product passageway 12 begins to communicate with feed tube 9. Upon continued rotation of the valve toward the completely open position, the product passageway begins to communicate with feed tube 9, allowing a certain extent of communication between the feed tube and mixing chamber so that a thin stream of liquid can pass to the mixing chamber 15 at a certain flow rate. The flow rate is the volume of liquid which can flow per unit of time through the feed tube, through the product passageway and into the mixing chamber. Upon continued rotation of the valve toward the completely open position, the extent of the communication between feed tube 9 and product passageway 12 increases, thereby increasing the extent of communication between the feed tube and the mixing chamber to allow a thicker stream of liquid to pass to the mixing chamber (i.e., an increased flow rate). However, the extent of communication between air orifice 13 and mixing chamber 15 is already at its constant maximum before product passageway 12 even begins to communicate with feed tube 9. Therefore, the ratio of liquid to air which is delivered to the mixing chamber will increase as the valve 10 is rotated toward the completely open position thereby increasing the wetness of the spray In the completely open position of valve 10, the extent of communication between product passageway 12 and feed tube 9 is at a maximum so that the ratio of liquid to air delivered to the mixing chamber is at a maximum. Thus, it can be seen that the wetness of the spray can be controlled by adjusting valve 10.

It should be appreciated by those skilled in the art that variations in the design of valve 10 are possible. For example, instead of being rotatable, the valve may be slidable so that the extent of communication between the product passageway 12 and feed tube 9 varies upon sliding motion of the valve.

Figure 2:
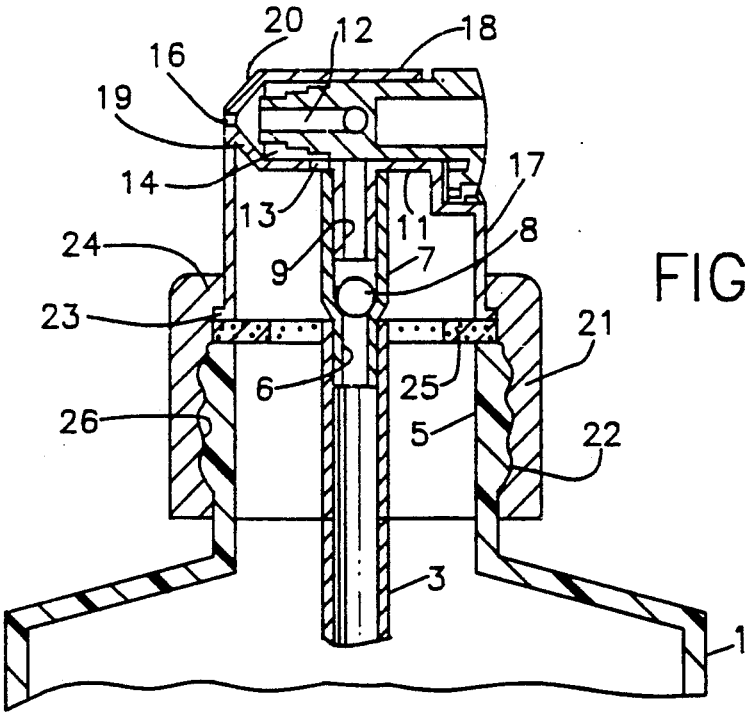
FIG. 2 is the same cross-sectional view which is illustrated in FIG. 1, but with the valve in its fully closed position.
Figure 3:
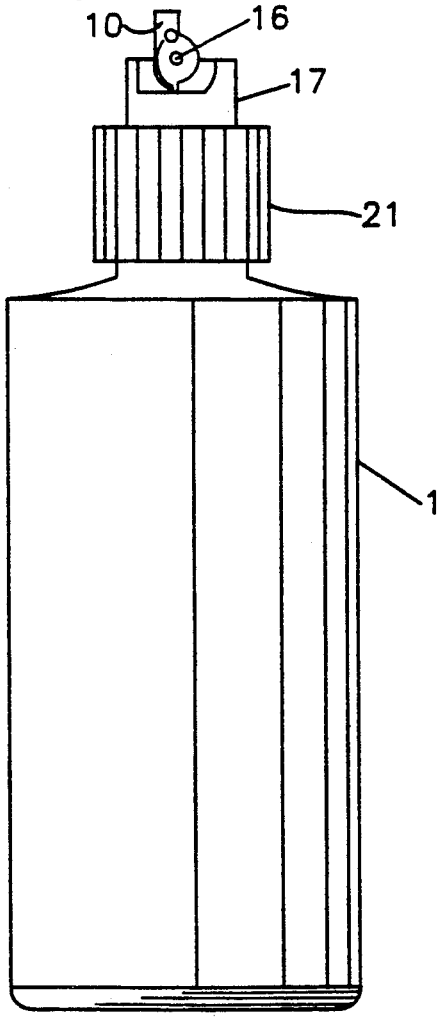
FIG. 3 is a perspective view of a squeeze bottle which includes a spray dispensing device in accordance with the invention.
Figure 4:
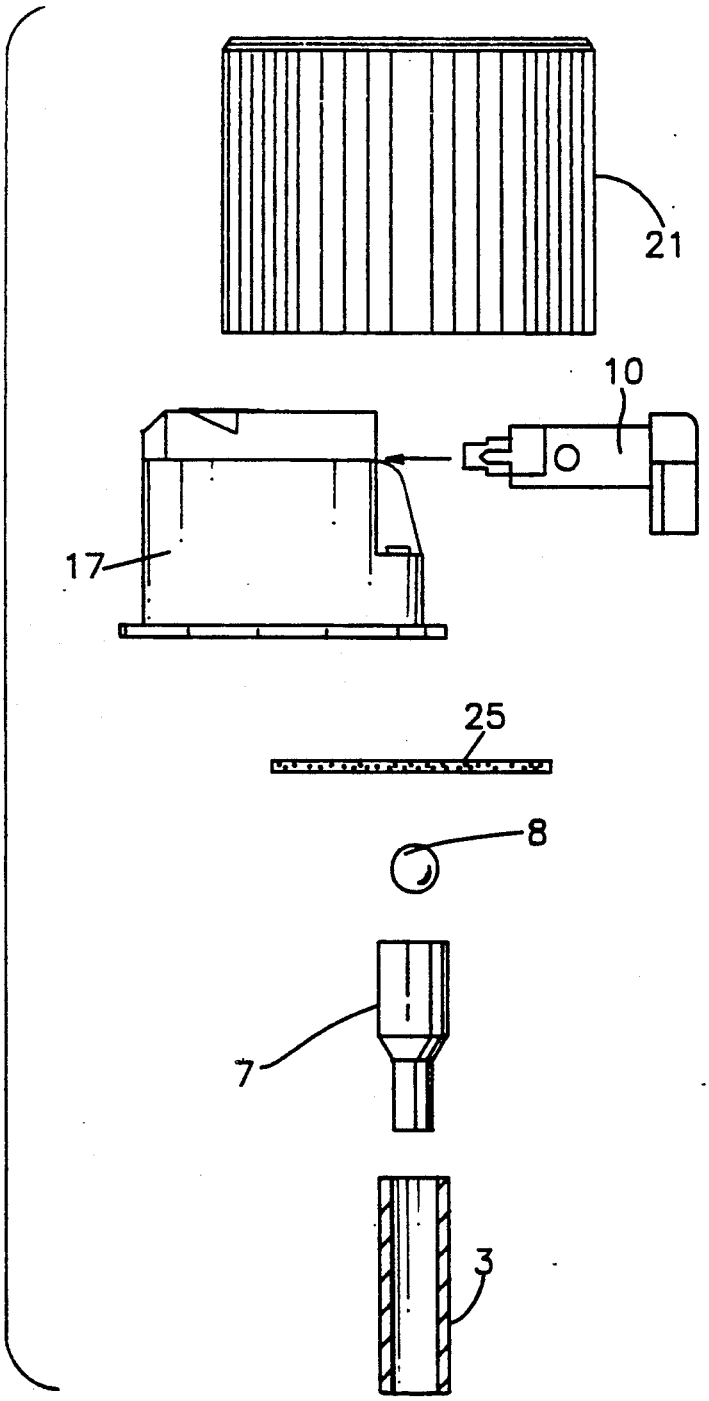
FIG. 4 is a segmented view of a spray dispensing device is accordance with the invention which illustrates the individual components of the device.

In the preferred embodiment the valve 10 is rotatable 90° from the completely closed position (FIG. 2) to the completely open position (FIGS. 1 and 3).

The operation of the spray dispensing device of the invention as used with a squeeze bottle will now be explained by describing the path of fluid and air. Upon squeezing the bottle 1 the pressure inside the bottle increases urging fluid 2 up dip tube 3. Fluid is forced through restricted conduit 6 and pushes ball 8 upward off of the top of conduit 6 thereby opening ballcheck valve 7. The fluid is then free to flow into feed tube 9 toward product passageway 12. From passageway 12 the fluid stream is injected into mixing chamber 15 in a horizontal direction.

Upon squeezing the bottle the increase in pressure also forces air above the fluid level in the bottle through air orifice 13 into air passageway 14. It can be seen that the distance which must be travelled by the air to reach the mixing chamber 15 is less than the distance which must be travelled by the liquid so that liquid does not reach the mixing chamber before the air. In this way, it is made certain that the fluid is mixed with air before emanating from orifice 16.

The air stream enters the open underside of mixing chamber 15. Tapered portion 19 of valve wall 11 directs the air stream at an acute angle to the horizontal stream of liquid. When liquid flows into the mixing chamber it is swirled around by the angular flow of air. The liquid is subjected to considerable turbulence which breaks it up and intimately mixes it with the air. The result is that a fine spray is propelled out of orifice 16.

When pressure is released on the container it returns to its original shape as external air is drawn into the container through orifice 16. The drawing of air through orifice 16 cleans the orifice and the mixing chamber 15 after each squeeze cycle thereby inhibiting clogging of the orifice. This self-cleaning feature of the invention is particularly advantageous in the case of a viscous product where clogging is most frequently encountered.

The release of pressure also causes liquid to drop down feed tube 9 which helps ball 8 to drop thereby closing the top of restricted conduit 6. It will be appreciated that the closing of conduit 6 by ball 8 will trap liquid in feed tube 3. Thus, during the next squeeze cycle product will already be at a very high level in the dip tube so that less time will transpire before spray is emitted. In this way the present invention achieves nearly instantaneous spraying without the need for a pressurized container.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. A spray dispensing device, for use with a non-pressurized container holding a volume of a liquid and air above the liquid wherein said container is actuated to increase air pressure within said container and to force liquid through a dip tube of the spray dispensing device, the spray dispensing device comprising:

a dispenser housing defining a cavity therein, with an air orifice and a liquid orifice being defined through an underside wall of said housing and a spray orifice being defined through a peripheral wall of said housing;

a dip tube extending from the underside wall and communicating with said liquid orifice; and a valve received in said cavity defining a mixing chamber in said cavity between the spray orifice and the valve, a liquid passageway defined in said valve and communicating with said mixing chamber, and an air passageway defined between said valve and said underside wall and communicating with said mixing chamber, said valve being selectively movable within said cavity between, at least: a first position wherein the air passageway communicates with the air orifice and wherein the liquid passageway communicates with the liquid orifice and the dip tube to define a first extent of communication between the dip tube and the mixing chamber, whereby a first stream of air can pass through said air orifice, through said air passageway and into said mixing chamber at a first air flow rate, and a first stream of liquid can pass through into dip tube, through said liquid orifice, through said liquid passageway and into said mixing chamber at a first liquid flow rate to engage the first stream of air such that a liquid-air mixture, characterized by a first ratio of liquid to air, can emanate from the spray orifice as a spray; and a second position wherein the air passageway communicates with the air orifice and wherein the liquid passageway communicates with the liquid orifice and the dip tube to define a second extent of communication between the dip tube and the mixing chamber which is greater than said first content, whereby a second stream of air can pass through said air orifice, through said air passageway and into said mixing chamber at a second air flow rate which is equal to said first air flow rate, and a second stream of liquid can pass through said dip tube, through said liquid orifice, through said liquid passageway and into said mixing chamber at a second liquid flow rate, greater than said first liquid flow rate, to engage the second stream of air such that a liquid-air mixture, characterized by a second ratio of liquid to air which is greater than said first ratio, can emanate from the spray orifice as a spray.

2. The spray dispensing device according to claim 1 wherein the valve is selectively movable within said cavity between said first position, said second position, and a multiplicity of further positions wherein the air passageway communicates with the air orifice in each further position and wherein the liquid passageway communicates with the liquid orifice and the dip tube to define a corresponding multiplicity of different extents of communication between the dip tube and the mixing chamber corresponding to each further position, whereby a stream of air can pass through said air orifice, through said air passageway and into said mixing chamber, and a stream of liquid can pass through said dip tube, through said liquid orifice, through said liquid passageway and into said mixing chamber at a corresponding multiplicity of different liquid flow rates corresponding to each further position.

3. The spray dispensing device according to claim 2 wherein the valve has a longitudinal axis aligned through the spray orifice and wherein the valve is selectively movable between said positions by rotation about said longitudinal axis.

4. The spray dispensing device according to claim 1 wherein the valve has a longitudinal axis aligned through the spray orifice and wherein the valve is selectively movable between said positions by rotation about said longitudinal axis.

5. The spray dispensing device according to claim 4 further comprising means for retaining liquid in the dip tube at a level which is higher than a level of liquid in the container upon deactuation of the container.

6. The spray dispensing device according to claim 1 wherein the valve is selectively movable between said positions by sliding movement within said cavity.

7. The spray dispensing device according to claim 1 further comprising means for retaining liquid in the dip tube at a level which is higher than a level of liquid in the container upon deactuation of the container.

8. The spray dispensing device according to claim 2 wherein the means for retaining liquid is a ballcheck means belonging to the dip tube.

9. The spray dispensing device according to claim 8 wherein the ballcheck means comprises a conduit and a ball, the conduit having a restricted section, characterized by a first inner diameter, communicating through a top of the dip tube, and a non-restricted section, characterized by a second inner diameter, communicating with said liquid orifice, said ball being disposed in said non-restricted section and being characterized by a third diameter which is greater than the first diameter and less than the second diameter such that the ball can move within the non-restricted section but not into the restricted section in response to movement of liquid through the conduit.

10. The spray dispensing device according to claim 9 further comprising a feed tube projecting from the underside wall of the spray dispenser housing and communicating with the liquid orifice and the non-restricted conduit, the feed tube being characterized by a diameter which is less than the third diameter so that the ball cannot move into the feed tube.

11. The spray dispensing device according to claim 1 wherein the dispenser housing has a terminal tapered section which is tapered in a direction toward the spray orifice, said terminal tapered section defining said mixing chamber.

12. The spray dispensing device according to claim 11 wherein the air passageway is concentrically disposed around a section of the valve.

13. The spray dispensing device according to claim 12, wherein a section of the liquid passageway is disposed toward the mixing chamber and the spray orifice in a horizontal direction and communicates with the mixing chamber at a location which is directly opposite the spray orifice and wherein the air passageway is disposed toward the mixing chamber in said horizontal direction and communicates with the mixing chamber at a location which is directly opposite the tapered section of the dispenser housing.

* * * * *

UNITED STATES PATENT AND TRADEMARK OFFICE

CERTIFICATE OF CORRECTION

'ATENT NO. : 5,183,186

IATED : February 2, 1993

NVENTOR(S) : DELANEY, Henry W., Jr.

It is certified that error appears in the above-identified patent and that said Letters Patent is hereby orrected as shown below:

:olumn 6, line 9, change "into" to --said--;

line 21, change "content" to --extent--; and

:olumn 7, line 5, change "claim 2" to --claim 7--.

Signed and Sealed this

Sixteenth Day of November, 1993

*Attest:*

Bruce Lehman

BRUCE LEHMAN

*Attesting Officer*

*Commissioner of Patents and Trademarks*